United States Patent [19]

Kilgour

[11] Patent Number: 4,688,345

[45] Date of Patent: Aug. 25, 1987

[54] TELESCOPIC SIGHT MOUNT

[75] Inventor: Norman R. Kilgour, Dearborn Heights, Mich.

[73] Assignee: J. B. Holden Co., Plymouth, Mich.

[21] Appl. No.: 803,113

[22] Filed: Nov. 29, 1985

[51] Int. Cl.[4] ..... F41G 1/38

[52] U.S. Cl. ..... 42/101; 33/250

[58] Field of Search ..... 42/1 ST; 33/249, 250; 403/21, 22, 362, 320

[56] References Cited

U.S. PATENT DOCUMENTS

| | | | |
|---|---|---|---|
| 1,770,451 | 7/1930 | Baker | 42/101 |
| 3,040,433 | 6/1962 | Heinzel | 42/101 |
| 3,259,986 | 7/1966 | Carr | 42/1 ST |
| 3,424,420 | 1/1969 | Seiderman | 42/101 |
| 3,463,430 | 8/1969 | Rubin et al. | 42/1 ST |
| 3,579,840 | 5/1971 | Heinzel | 42/1 ST |
| 3,611,606 | 10/1971 | Sefried et al. | 42/101 |
| 3,750,318 | 8/1973 | Burris | 33/250 |
| 3,986,285 | 10/1976 | Krisay | 42/1 ST |
| 4,509,282 | 4/1985 | McMillon | 42/1 ST |

FOREIGN PATENT DOCUMENTS 299177 12/1919 Fed. Rep. of Germany ..... 33/250

OTHER PUBLICATIONS

Sako (Finland) Scope Mount–Exhibits A and B.

Shooter's Bible, 1980 Edition, pp. 437, 438 and 444.

*Primary Examiner*—Deborah L. Kyle

*Assistant Examiner*—Michael J. Carone

*Attorney, Agent, or Firm*—Burton, Parker & Schramm

[57] ABSTRACT

A telescopic sight mount for attachment to a pair of inwardly inclined surfaces on opposite sides of a sight mounting surface includes a mount body having a surface adapted to bear against the sight mounting surface and also having an inclined surface for cooperation with one of the inclined surfaces at one side of the sight mounting surface, and a shoe clamp pivotably connected by screw means to the mount with one end bearing against the mount and another end bearing against the other inclined surface at the opposite side of the sight mounting surface.

9 Claims, 10 Drawing Figures

FIG.4
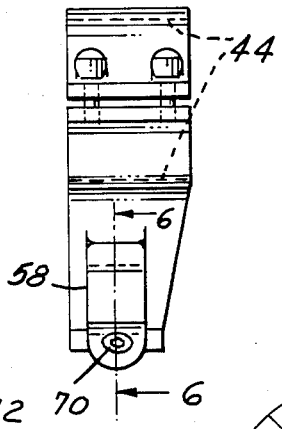
FIG.5
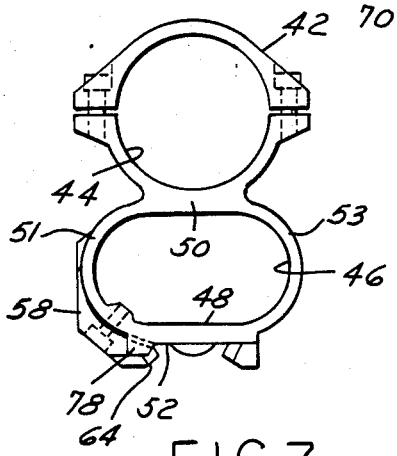
FIG.6
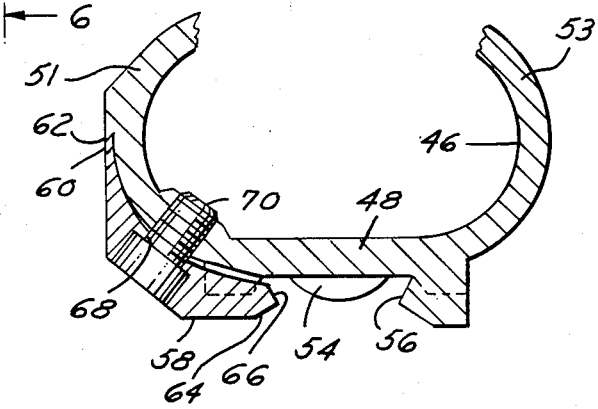
FIG.7
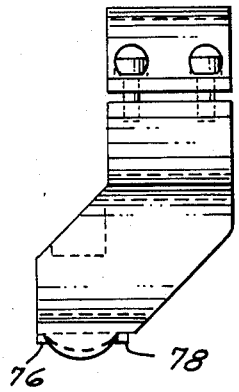
FIG.8
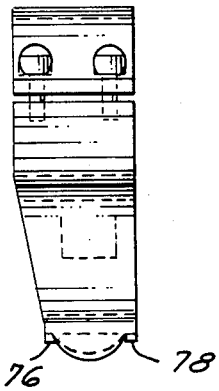
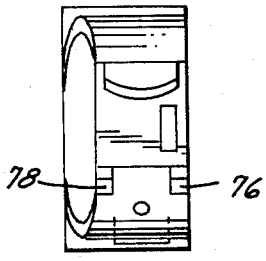
FIG.9
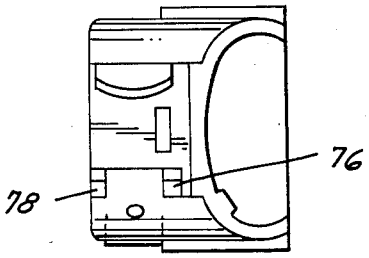
FIG.10

TELESCOPIC SIGHT MOUNT

FIELD OF INVENTION

This invention relates to the field of telescopic sight mounts, and more particularly to telescopic sight mounts removably attachable to a gun having an integral sight mounting surface formed therein.

BACKGROUND OF INVENTION

Telescopic sights or scopes are typically mounted to a gun using a pair of mounts attached to the scope and to the receiver or barrel portion of the gun. The mounts may be attached to the gun using screws which thread directly into the gun itself, or using a variety of clamping devices which engage oppositely disposed V-shaped grooves attached to or integrally formed into the gun.

Telescopic sights or scopes have been attached to rifles using a wide variety of mounts. Before telescopic sights became so popular, it was frequently necessary for the gun barrel receiver to be drilled and tapped so that scope mounts could be affixed to the gun with screws. Most modern high-power rifles come predrilled and tapped for scope mount attachment at the factory, with the holes being filled with dummy screws. It has long been a practice with small bore low power rifles, particularly 0.22 caliber rifles, to machine a pair of female grooves on opposite sides of the receiver for attachment of scope mounts. Since 0.22 caliber rifles have very little recoil, axial movement on the scope mounts relative to the gun is not a problem.

It has been a practice of some scope mount manufacturers to attach a plate to the gun defining a pair of dovetail grooves for attachment of the mount. In the late 60's Sturm Ruger and Co. introduced their No. 1 Series, which included a rib attached to the gun having grooves already formed therein for a scope mount attachment. Rather than form the rib for a scope attachment as a separate piece, a number of manufacturers have formed integral dovetail grooves in the receiver of the gun for attachment of scopes. These manufacturers include Sako (Finnish), BSA (British), Mauser (Czechslovakian), and Ruger (U.S.).

In order to prevent axial movement of the mount relative to the gun due to recoil, a number of manufacturers have included lugs or projections on the scope mount which are received in a corresponding recess in the receiver or mount attachment base, as is done with Sako, BSA and Ruger rifles. One of the male dovetails may be formed in the mount and the other adjustable relative thereto as in the case of the Ruger design or both male dovetails attached to the mount may be adjustable as in the case of Sako. Having both male dovetails adjustable allows the scope to be adjusted relative to the gun for windage, an important feature on some of the older European scopes not having internal windage adjustments.

Scope mounts referred to as "See-Thru" have been made for a number of years by J. B. Holden Co. and others. A "See-Thru" mount allows the user of the gun to alternatively use the telescopic sight or conventional open metallic sights. "See-Thru" scope mounts are typically in a figure-8 shape, having a top tubular opening for retention of the scope and a lower tubular opening for free viewing of the iron sight along an axis parallel to the gun bore. It is desirable to have the scope axis as close to the gun bore axis as possible to minimize parallax error. "See-Thru" mounts are typically screwed directly to the gun receiver. In guns which do not employ the "See-Thru" feature, the distance between the scope and bore axis is not nearly as important, as the scope lens diameter typically limits the relative spacing as opposed to mount structure.

A number of scope mounts have been designed so that the scope and mount can be removed and subsequently re-attached to the gun without varying its point of aim or sighting appreciably. These designs typically employ a fixed male dovetail groove which fits into a corresponding female groove attached to or integrally formed in the receiver. A through bolt extends through the mount and supports an adjustable member for cooperation with the opposite female dovetail groove. A separate dependent lug or the transverse through bolt serve to axially align the mount, while the fixed male dovetail serves to laterally align the mount so that it can be removed and re-installed in nearly the identical position. Examples of mounts employing one male dovetail and a movable dovetail adjusted by a transverse through bolt are shown in U.S. Pat. Nos. 3,611,606; 3,424,402 and 3,040,433.

Prior scope mounts of prior art designs typically have one or more of the following problems. They are expensive and made up of many machine parts. They tend to loosen up as a result of recoil and cannot be accurately removed and re-installed in the same place. They tend to be ugly and have numerous sharp edges and projecting parts to snag clothes and brush and, particularly in the case of See-Thru mounts, scopes where are frequently mounted a great distance from the gun bore.

SUMMARY AND OBJECTS OF THE INVENTION

A primary object of the present invention is to provide an inexpensive, strong, telescopic sight mount which can be accurately removed and re-installed on a gun in substantially the same place.

Another object of the invention is to provide a scope mount free of sharp edges and projecting parts to snag clothes and brush and which is aesthetically pleasing.

The present invention is directed to a scope mount which enables a scope to be securely removably attached to a gun having a sight mounting surface and a pair of inwardly inclined bearing surfaces or grooves on opposite sides of the sight mounting surface which is attached to or integrally formed in the gun. The mount is provided with a lower mounting surface adapted to bear against the sight mounting surface and has an inclined face for cooperation with one of the inclined bearing surfaces of the gun. The mount is provided with a shoe clamp which has a first end which pivotably cooperates with the mount body and a second end having an inclined face which cooperates with the second inclined bearing surface of the gun. The shoe clamp has a central region between the first and second ends through which an adjustment screw means projects. The shoe clamp is shiftably supported on the screw means for pivotable movement relative to the mount body about said first end. Such adjustment of the screw means causes the inclined face of the second end of the shoe clamp to move into engagement or disengagement with the inclined bearing surface on the gun for attachment or detachment of the mount thereto.

An important feature of the invention is that a mount may be made with few parts and minimal machining.

Another feature of the invention is that a compact See-Thru mount can be constructed which allows minimum scope to bore spacing and maximum viewing area of the gun's metal sights.

An important advantage of the invention is that mounts of this design can be removed and re-attached without appreciable movement of point of aim and the attachment mechanism is very compact, resulting in an aesthetically pleasing mount which does not have sharp edges and projections which would snag clothes and brush.

Another significant advantage of the invention is that it can be made quite economically since there is little machining required for the case parts forming the mount.

Other features and advantages of the invention can be appreciated after review of the drawings and the description of the preferred embodiment.

BRIEF DESCRIPTION OF THE DRAWINGS

FIG. 4 is a left side elevation view of the front mount;

FIG. 5 is an end view along the sighting plane, the opposite end view being a mirror image thereof;

FIG. 6 is an enlarged sectional view taken along line 6—6 in FIG. 4;

FIG. 7 is a right side elevation view of the rear mount;

FIG. 8 is a right side elevation view of the front mount;

FIG. 9 is a bottom view of the front mount; and

FIG. 10 is a bottom view of the rear mount.

BRIEF DESCRIPTION OF THE PREFERRED EMBODIMENT

Figure 1:
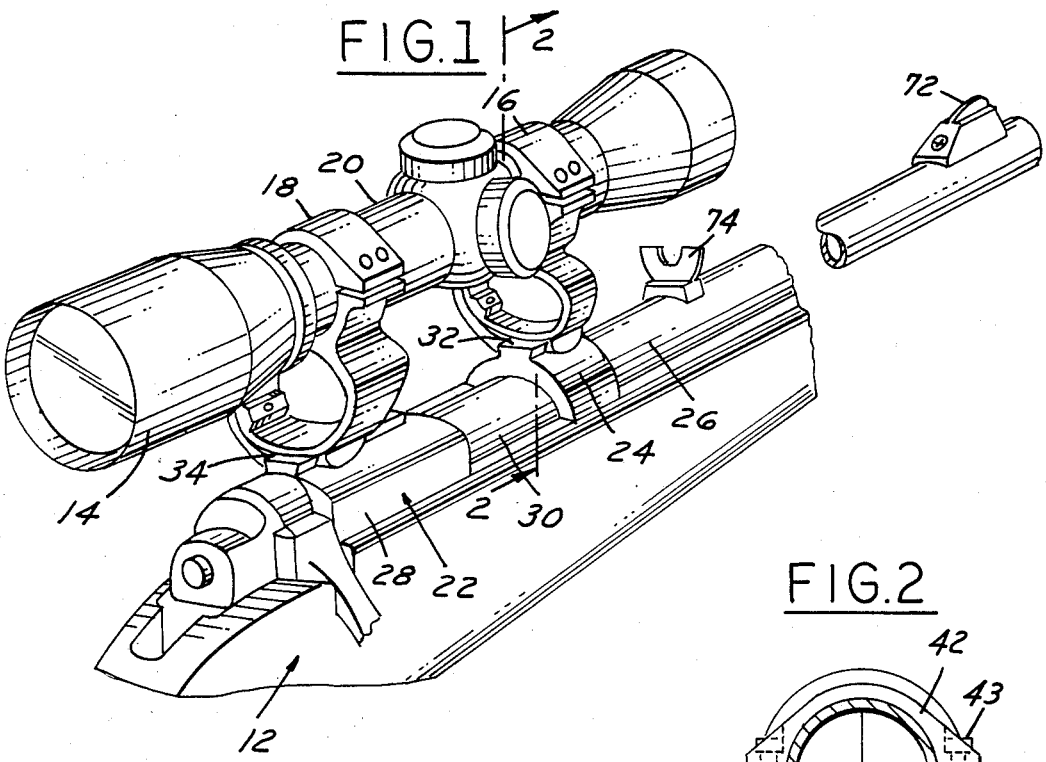
FIG. 1 is a perspective view of a pair of scope mounts shown holding a scope on a rifle.

Referring to the drawings, one preferred embodiment of the scope mount will be described in detail. As the preferred embodiment of the invention has been specifically designed for attachment to a Model 77 Ruger Series rifle, the entire contents of U.S. Pat. No. 3,611,606, which also relates to a Ruger Model 77 rifle, is incorporated herein by reference.

In FIG. 1, a gun, namely, a bolt action rifle 12 is shown with a scope 14 attached thereto by a front and rear scope mount 16 and 18 respectively. The scope is of conventional design with a 1" diameter central tube 20. The scope mount is attached to the tube 20 and to the receiver 22 of the rifle. The receiver is provided with a ring region 24 to which the barrel 26 is attached. Receiver 22 is further provided with a receiver bridge portion 28 located rearward of the shell ejection portion through which bolt 30 is seen in FIG. 1. Both the ring and bridge portions of the receiver are provided with a sight-mounting surface 32 and 34. These sight-mounting surfaces are frequently referred to as an "integral rib design".

Figure 2:
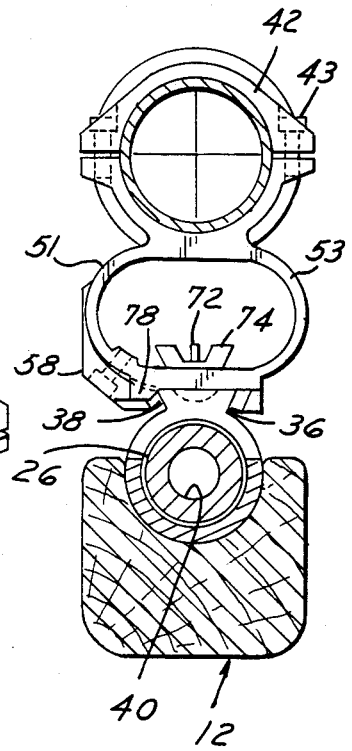
FIG. 2 is a cross-sectional view of the gun, mount and scope assembly in FIG. 1, taken along line 2—2.
Figure 3:
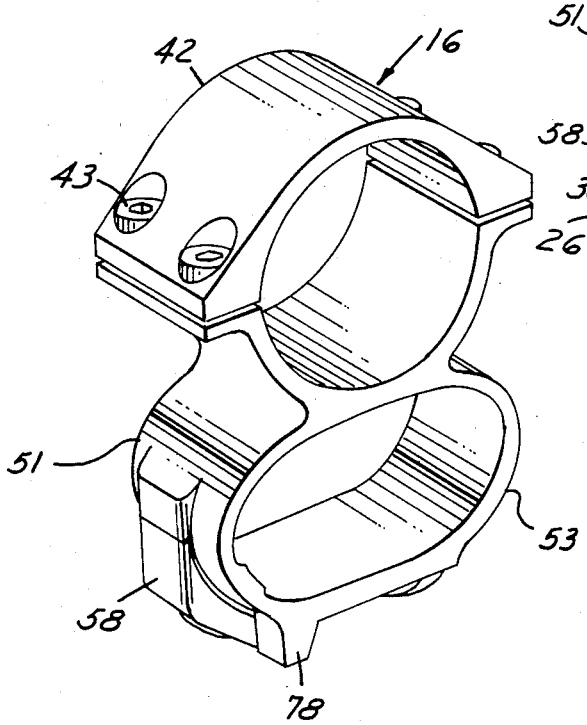
FIG. 3 is an enlarged perspective view of the front mount.

The sight mounting surface is provided with a pair of inwardly inclined bearing surfaces 36 and 38, as shown in FIG. 2. Additional detail of the rifle structure is shown in FIGS. 2–4 of the U.S Pat. No. 3,611,606. Each inclined bearing surface lies in a plane which is generally parallel to the axis of bore 40. In the preferred embodiment of the invention shown, the inclined bearing surfaces are only machined at discrete locations where the mounts will be attached. However, it would be possible to have dovetail grooves extending the length of the receiver to provide inclined bearing surfaces.

As shown in FIGS. 2 and 5, the mount is in the general shape of a figure-8. The upper circular opening is defined by a removable cap 42 and a semi-cylindrical inner surface 44 formed in the mount. Cap 42 has a corresponding semi-cylindrical inner surface to define a cylindrical surface for cooperation with the center tube 20 of the scope. Cap 42 is removably attached to the mount by four recessed screws 43. The lower tubular opening 46 is oval or oblong, with the long axis thereof being generally horizontal. The mount assembly, when viewed from the end, as in FIGS. 2 and 5, is provided with three horizontal webs, lower web 48, central web 50, and the upper web provided by cap 42. Arcuate side walls 51 and 53 connect the central and lower webs to define the generally oval lower tubular opening 46 in the mount body. Lower web 48 is provided with a lower mounting surface 52 adapted to bear against the sight mounting surface of the gun. Lower mounting surface 52 is preferably provided with a lug 54 dominantly projecting therefrom which projects into a corresponding transverse slot (not shown) in the sight mounting surface of the gun. Lug 54 prevents axial movement of the mount relative to the gun, which could otherwise be caused by recoil.

Integrally formed in the mount adjacent to the lower mounting surface 52 is an inclined face 56 which cooperates with one of the inclined bearing surfaces of the gun. On the opposite side of the lower sight mounting surface a shoe clamp 58 is attached to the mount. The shoe clamp is provided with a first end 60 which pivotably cooperates with a rib 62 in the side of the mount. The shoe clamp is provided with a second end 64, which has inclined face 66, which cooperates with the second inclined bearing surface of the gun 38. The shoe clamp has a central region disposed between the first and second ends, having a hole 68 formed therein. Screw 70 projects through hole 68 and provides adjustment screw means for attaching the central region of the shoe clamp to the mount body. Hole 68 is sufficiently large relative to screw 70 so that the shoe clamp can freely pivotably rotate about the first end retained in rib 62. The screw threadedly engages the arcuate side wall 51 of the mount body as shown. As the screw is adjusted, the shoe clamp pivotably moves relative to the mount body about the first end so that adjustment of the screw causes inclined face 66 to move in or out of cooperation relationship with inclined bearing surface 38 on the gun. As shown in the prefered embodiment, the plane of the inclined bearing surface is located 30° relative to the vertical, and the axis of the screw 70 is oriented 80° from the plane of the inclined bearing surface. It is preferred that the axis of the screw be located generally perpendicular to the plane of the inclined bearing surface and the corresponding plane of face 66.

Each mount is further provided with a front and rear locator boss 76 and 78 located immediately adjacent the lower mounting surface 46 on opposite sides of shoe clamp 48. The front and rear locator provide meet guide means to prevent the shoe clamp from rotating or moving fore and aft.

It is important that a scope mount be securely affixed to the rifle and not loosened or moved when bumped or vibrated. It is believed that the shoe clamp design mount is unlikely to loosen in the most severe usage. The shoe clamp acts as a beam supported by its two ends and centrally loaded by screw 70. When the screw is tightened, the screw will turned a predetermined amount after the slack in the system is taken up and the parts are all in contact with one another. The elasticity in the attachment is a result of the bending of the shoe clamp, stretch of screw and slight elastic deformation of the mount body itself. The elasticity of this attachment maintains the screw in constant tension and thereby effectively prevents loosening due to vibration.

As is shown in FIG. 2, lower and central webs 48 and 50 can be made quite thin. This results in maximum viewing area through lower tubular opening 46. While the lower tubular opening is shown oval, alternatively it may be round or some other shape. However, oval works quite well, particulary on hunting rifles where a greater horizontal viewing area is desirable. The user of the rifle can view the metallic front and rear sights through the lower tubular opening, or, alternatively, look through the scope retained in the upper cylindrical opening of the mount. The axis of the rifle bore, the line of sight of the metallic sights, and the like of sight of the scope are generally parallel. However, these axes will typically be adjusted to intersect at a sighting point some remote distance from the rifle, typically 100 or 200 yards. If, for example, the scope was aimed at an object point 50 yards away, the bullet would strike low due to what is referred to as parallax error. By mounting the scope as close to the bore of the rifle as possible, as the preferred embodiment allows, parallax error is minimized and there is ample field of view through the lower tubular opening to utilize the gun's open sights.

As can be seen from FIGS. 7–10, particularly the side view of the rear mount in FIG. 7, one or both of the mounts may be offset when the distance between the mounting points on the rifle are greater than the distance between the mount attachment points on the scope tube 20. The amount of offset may have to be varied to fit the scope to rifles having different spacings between the receiver ring and the receiver bridge. This spacing is typically a function of cartridge length.

In addition to the present mount being strong, compact, and readily removable and re-attachable, the mount has a number of other distinct advantages. An important feature of the mount is that it can be made of three castings and a number of standard screws. The castings, namely, the main mount body, the cap and the shoe clamp, are preferably investment cast steel. If the investment casting is done carefully and accurately, the only machining required is the tapping of holes for the screws. The invention casting process also allows the wall sections to be made quite thin, resulting in a lightweight yet strong mount free of sharp corners or edges.

In operation, mounts will typically be used in pairs, as shown in FIG. 1. The mounts will be first attached to the gun by loosening screw 70 and pivoting the inclined face 66 of shoe clamp 58 away from the mount body. Inclined face 56 formed in the mount is then placed in contact with the right inclined bearing surface 36 on the gun. The mount is then rotated counterclockwise, as shown in FIG. 2, so that lug 54 is inserted in the corresponding recess in the gun and lower mounting surface 52 of the mount comes into parallel engagement with the sight mounting surface of the gun. Screw 70 is then tightened, causing shoe clamp 58 to protate about its first end 60 which is retained in recess groove 62 formed in the mount. As screw 70 is rotated, the inclined face of the shoe clamp 66 will shift into engagement with the left inclined bearing surface on the gun. When the screw is tight, the mount will be securely attached to the gun. The shoe clamp is further prevented from rotating about screw 70 by front and rear locator bosses 76 and 77 which project from the mount body.

With both mounts attached in the above described manner, the tube 20 of the scope is placed in contact with the semi-cylindrical surface 44 of each of the scope mounts. The caps 42 are then re-installed with screws 43 to securely attach the scope to the two mounts and the gun. The scope can then be sighted-in in a conventional manner. A hunter using a gun equipped with a See-Thru scope of the type shown in the preferred embodiment can alternatively look through the scope or the lower tubular openings 46 in the mount to view the metal of front and rear sights 72 and 74 as shown in FIG. 2. If it is desired to remove the scope from the gun once it has been installed and sighted-in, it is only necessary to loosen two screws 70, one in each mount allowing the shoe clamp to pivot clockwise about its first end 60, as shown in FIG. 6. With inclined face 66 on the second end of the shoe clamp moved out of contact with inclined bearing face 38 on the gun, the scope with the mounts attached may be removed as a unit. The scope can subsequently be re-installed in the reverse sequence and the point of aim of the scope will not change appreciably since inclined faces 56, lower mounting surface 52 and lug 54 on the mount will match up quite accurately with the corresponding mating surfaces on the gun.

It will also be understood, of course, that while the form of the invention herein shown and described constitutes a preferred embodiment of the invention, it is not intended to illustrate all possible forms thereof. It will also be understood that the words used are words of description rather than limitation and various changes may be made without departing from the spirit and scope of the invention disclosed.

I claim:

1. In a mount for removably attaching a telescopic sight to a gun having a sight-mounting surface and a pair of inwardly inclined bearing surfaces on opposite sides of the sight mounting surface, wherein the mount comprises:

a mount body cooperating with the telescopic sight and having a lower mounting surface adapted to bear against the sight-mounting surface of the gun and provided with an inclined face for cooperation with one of the inclined bearing surfaces of the gun;

a shoe clamp having a first end for cooperation with the mount body, a second end having an inclined face for cooperation with the second inclined bearing surface of the gun, pair of generally parallel sides extending between said first and second ends, and a central region disposed between the first and second ends;

a locator boss projecting from the mount body adjacent the shoe clamp second end for cooperation with a side of the shoe clamp to restrict movement thereof;

screw means for adjustable attachment of the central region of the shoe clammp to the mount body with the ends of the shoe clamp cooperating with the gun and mount body as aforesaid; and said shoe clamp shiftably supported on said screw means for pivotal movement relative to the mount body about said first end such that upon adjustment of the screw means the incline face on said second end will shift into engagement with the other inclined bearing surface on the gun to attach the mount body thereto.

2. The invention of claim 1 wherein the gun is further provided with a recess in the sight mounting surface between the first and second inwardly incline bearing surfaces and said mount further comprises a lug projecting from the lower mounting surface for cooperation of the gun recess further preventing movement of the mount relative to the gun.

3. The invention of claim 1 wherein the screw means is rotatable upon an axis generally perpendicular to the second inclined bearing surface of the gun and further lying in a plane generally perpendicular to the axis of the gun bore.

4. In a see-thru mount for removably attaching a telescopic sight to a gun having a sight-mounting surface and a pair of inwardly inclined bearing surface on opposite sides of the sight mounting surface, wherein the mount comprises:

a figure-8 shaped mount body provided with an upper tubular opening for supporting a telescopic sight and a lower tubular opening for providing visual access to the gun's open sights, said mount body further provided with a lower mounting surface adapted to bear against the sight-mounting surface of the gun and provided with an inclined face for cooperation with one of the inclined bearing surfaces of the gun;

a shoe clamp having a first end for cooperation with the mount body and a second end having an inclined face for cooperation with the second inclined bearing surface of the gun, and a central region disposed between the first and second ends;

a pair of locator bosses projecting from the mount body adjacent and on opposite sides of the shoe clamp second end to restrict movement thereof;

adjustment screw means for attaching the central region of the shoe clamp to the mount body with the ends of the shoe clamp cooperating with the gun and mount body as aforesaid; and said shoe clamp shiftably supported on said screw means for pivotal movement relative to the mount body about said first end such that upon adjustment of the screw means the incline face on said second end will shift into engagement with the other inclined bearing surface on the gun to attach the mount body thereto.

5. The invention of claim 4 wherein the gun is further provided with a recess in the sight mounting surface between the first and second inwardly inclined bearing surfaces and said mount further comprises a lug projecting from the lower mounting surface for cooperation of the gun recess further preventing movement of the mount relative to the gun.

6. The invention of claim 4 wherein said figure-8 shaped mount body is provided with a lower web, a central web and an upper removable cap, said upper tubular opening is defined by the central web and the cap each having semi-cylindrical surfaces for supporting the scope, and said lower tubular opening is defined in part by the central web and the lower, said outer periphery of the lower web being provided with a lower mounting surface for cooperation with the sight mounting surface of the gun.

7. The invention of claim 6 wherein said mount body is further provided with a first and second arcuate side wall connecting the center web to the lower web, thereby forming a continuous wall defining the lower tubular opening, said first wall cooperating with the shoe clamp and the adjustment screw means for attachment of same.

8. The invention of claim 4 wherein said mount body is further provided with a raised rib defining a V-shaped groove for pivotably receiving the first end of the shoe clamp.

9. In a see-thru mount for removably attaching a telescopic sight to a gun having a sight mounting surface and a pair of inwardly inclined bearing surfaces on opposite sides of the sight mounting surface, wherein the mount comprises:

a mount body and a removable semi-cylindrical cap forming a figure-8 shaped mount assembly having an upper tubular opening for supporting a telescopic sight and a lower tubular opening for providing visual access to the open sights of the gun, said mount body further provided with a lower mounting surface adapted to bear against the sight mounting surface of the gun and provided with an inclined face for cooperation with one of the inclined bearing surfaces of the gun;

a shoe clamp having a first end for cooperation with the mount body and a second end having an inclined face for cooperation with the second inclined bearing surface of the gun, and a central region disposed between the first and second ends;

a lug projecting from the lower mounting surface of the mount body for cooperation with a recess in the gun;

adjustment screw means for attaching the central region of the shoe clamp to the mount body with the ends of the shoe clamp cooperating with the gun and mount body as aforesaid;

a pair of locator bosses projecting from the mount body adjacent and on opposite sides of the shoe clamp second end to restrict movement thereof; and said shoe clamp shiftably supported on said screw means for pivotal movement relative to the mount body about said first end such that upon adjustment of the screw means the incline face on said second end will shift into engagement with the other inclined bearing surface on the gun to attach the mount body thereto.

* * * * *